US010409208B2

(12) United States Patent
Okamoto et al.

(10) Patent No.: US 10,409,208 B2
(45) Date of Patent: Sep. 10, 2019

(54) IMAGE FORMING APPARATUS FOR FORMING IMAGE ON SHEET

(71) Applicant: KYOCERA Document Solutions Inc., Osaka (JP)

(72) Inventors: Sueaki Okamoto, Osaka (JP); Eiji Nimura, Osaka (JP); Koji Kuramashi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/965,089

(22) Filed: Apr. 27, 2018

(65) Prior Publication Data

US 2018/0314198 A1 Nov. 1, 2018

(30) Foreign Application Priority Data

Apr. 27, 2017 (JP) ..... 2017-088439

(51) Int. Cl.
*G03G 15/00* (2006.01)
*G03G 15/08* (2006.01)

(52) U.S. Cl.
CPC ..... *G03G 15/5012* (2013.01); *G03G 15/0863* (2013.01); *G03G 15/55* (2013.01)

(58) Field of Classification Search
CPC ... G03G 2215/209; G03G 2215/00569; G03G 2215/207
See application file for complete search history.

(56) References Cited

U.S. PATENT DOCUMENTS 5,669,039 A * 9/1997 Ohtsuka ..... G03G 15/2003 399/400
7,127,188 B2 * 10/2006 Akita ..... G03G 15/205 399/67
7,962,052 B2 * 6/2011 Ishino ..... G03G 15/2039 399/12
8,306,446 B2 * 11/2012 Ito ..... G03G 15/2039 399/329

(Continued)

FOREIGN PATENT DOCUMENTS

JP 2011-028017 A 2/2011

*Primary Examiner* — Clayton E. LaBalle
*Assistant Examiner* — Leon W Rhodes, Jr.
(74) *Attorney, Agent, or Firm* — IP Business Solutions, LLC

(57) ABSTRACT

An image forming apparatus includes a conveyance section, an image forming section, a fixing section, a sheet output tray, a toner container, a suitable product determining section, and a control section. The suitable product determining section determines whether the toner container loaded in an apparatus body is a suitable product. When the suitable product determining section determines that the toner container is not a suitable product, on condition of successive feeding of sheets, the control section allows, after every predetermined number of sheets have been subjected to an image forming operation, a fixing aging operation for stopping the image forming operation and rotating rotating bodies of the fixing section to be performed. When the suitable product determining section determines that the toner container is a suitable product, the control section keeps the fixing aging operation conditional on successive feeding of sheets from being performed.

2 Claims, 6 Drawing Sheets

(56) References Cited

U.S. PATENT DOCUMENTS

| | | | | |
|---|---|---|---|---|
| 8,639,135 | B2 * | 1/2014 | Okada | G03G 15/0849 399/39 |
| 9,176,425 | B2 * | 11/2015 | Takami | G03G 15/0887 |
| 9,239,542 | B2 * | 1/2016 | Kasai | G03G 15/0863 |
| 9,310,743 | B2 * | 4/2016 | Shiraishi | G03G 15/0121 |
| 9,367,021 | B2 * | 6/2016 | Ishizuka | G03G 15/0178 |
| 9,436,142 | B1 * | 9/2016 | Yamada | G03G 15/2046 |
| 2014/0193168 | A1 * | 7/2014 | Kimoto | G03G 15/205 399/69 |

* cited by examiner

IMAGE FORMING APPARATUS FOR FORMING IMAGE ON SHEET

INCORPORATION BY REFERENCE

This application claims priority to Japanese Patent Application No. 2017-088439 filed on Apr. 27, 2017, the entire contents of which are incorporated by reference herein.

BACKGROUND

The present disclosure relates to image forming apparatuses and particularly relates to a technique for dealing with an inadequate toner container.

A general electrophotographic image forming apparatus includes: a photosensitive drum as an image carrier; a charging device that electrically charges the photosensitive drum; an exposure device that irradiates the charged surface of the photosensitive drum with laser light based on an original document to form a latent image of the original document on the surface of the photosensitive drum; a developing device that visualizes the latent image with toner; a transfer roller that transfers a toner image formed by the visualization to a sheet; and a fixing section that fixes the transferred toner image on the sheet.

Recently, there is increasing use of inadequate toner containers different from a suitable toner container recommended as a product suitable for an image forming apparatus. Since the inadequate products are different in performance in the suitable product, the use of inadequate toner containers may prevent provision of a sufficient level of performance of the image forming apparatus.

There is a general image forming apparatus that determines whether or not a loaded toner container is a suitable product using a radio-frequency (RF) tag attached to the toner container and a radio-frequency identification (RFID) communication device mounted to an apparatus body of the image forming apparatus. When determining that the loaded toner container is an inadequate product, the image forming apparatus allows its display panel to display a warning message informing the user that an inadequate toner container is loaded, thus prompting the user to use a suitable toner container.

SUMMARY

A technique improved over the above technique is proposed as one aspect of the present disclosure.

An image forming apparatus according to an aspect of the present disclosure includes an image forming section, a fixing section, a toner container, a suitable product determining section, and a control section. The image forming section includes an image carrier and forms a toner image on a surface of the image carrier. The fixing section nips, at a fixing nip between two rotating bodies, a sheet having the toner image formed in the image forming section and applies heat and pressure to the nipped sheet to fix the toner image on the sheet. The toner container is removably loadable in an apparatus body of the image forming apparatus and contains toner for use in forming the toner image in the image forming section. The suitable product determining section determines whether or not the toner container loaded in the apparatus body is a suitable product. The control section controls operations of the image forming section and the fixing section. The image forming section includes a developing device that supplies to the image carrier the toner supplied from the toner container and forms the toner image on the image carrier. When the suitable product determining section determines that the toner container loaded in the apparatus body is not a suitable product, on condition that successive feeding of sheets for image formation is performed, the control section allows, after every predetermined number of sheets have been subjected to an image forming operation, a fixing aging operation for stopping the image forming operation and rotating the rotating bodies of the fixing section to be performed. When the suitable product determining section determines that the toner container loaded in the apparatus body is a suitable product, the control section keeps the fixing aging operation conditional on occurrence of the successive feeding of sheets from being performed.

DETAILED DESCRIPTION

Figure 1:
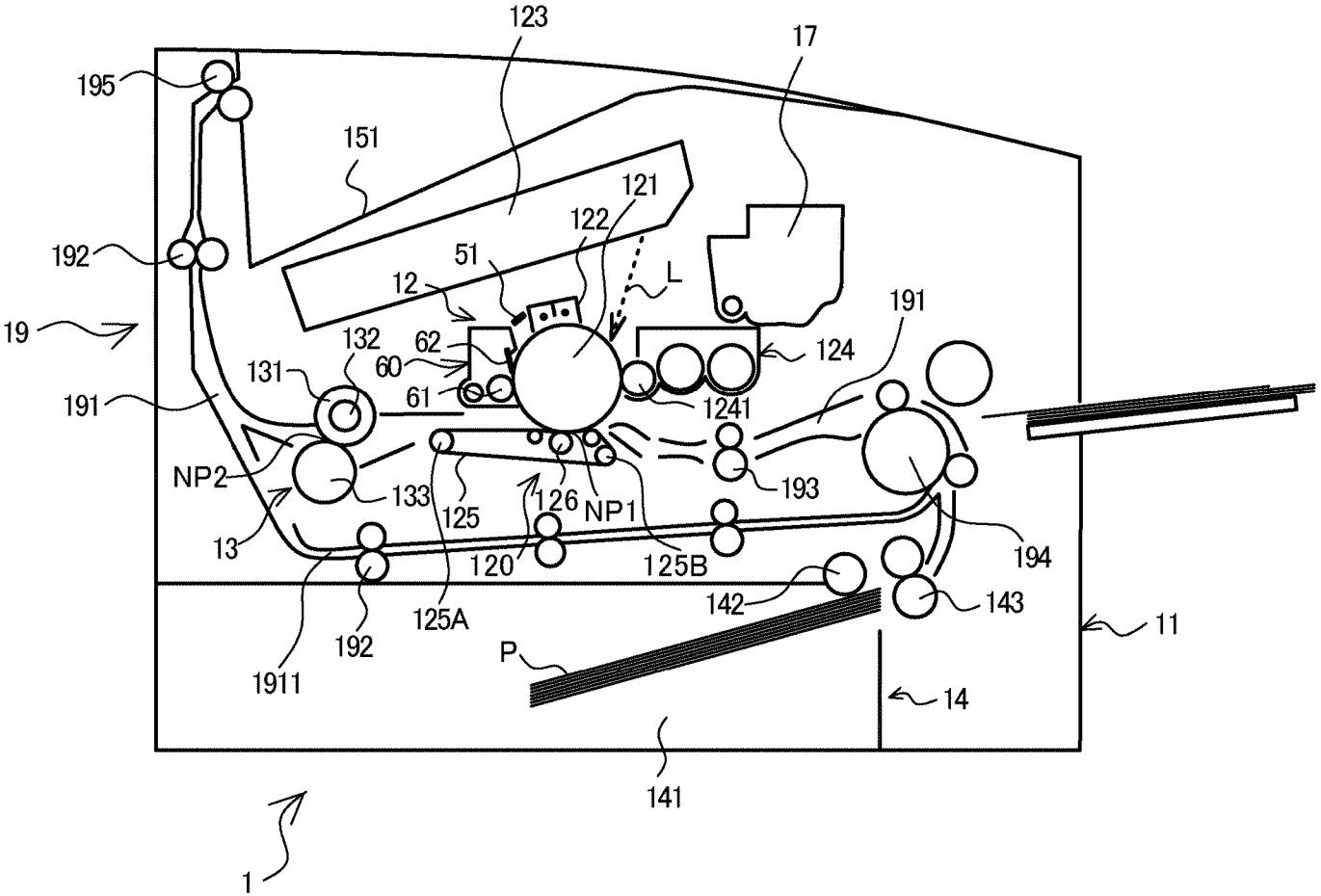
FIG. 1 is a schematic cross-sectional side view showing the structure of an image forming apparatus according to a first embodiment of the present disclosure.

Hereinafter, a description will be given of an image forming apparatus according to an embodiment of the present disclosure with reference to the drawings. FIG. 1 is a schematic cross-sectional side view showing the structure of an image forming apparatus 1 according to a first embodiment of the present disclosure. The image forming apparatus 1 is, for example, a printer and is made up so that an apparatus body 11 thereof includes a sheet feed section 14, an image forming section 12, a toner container 17, a fixing section 13, and a sheet output tray 151. The image forming apparatus 1 further includes a conveyance section 19 that conveys a sheet P (for example, a recording sheet or recording paper) from the sheet feed section 14 via the image forming section 12 and the fixing section 13 to the sheet output tray 151.

The conveyance section 19 includes: a conveyance path 191 connecting between the sheet feed section 14 and the sheet output tray 151; a reverse conveyance path 1911; a plurality of conveyance roller pairs 192 disposed at appropriate locations in the conveyance path 191 and the reverse conveyance path 1911; a registration roller pair 193; a conveyance drum 194, and an output roller pair 195.

The sheet feed section 14 is provided at the bottom of the apparatus body 11 and includes: a sheet feed cassette 141 capable of containing a plurality of sheets P; a first pick-up roller 142 capable of picking up the sheets P contained in the sheet feed cassette 141 sheet by sheet; and a sheet feed roller pair 143 that carries forward the sheet P picked up by the first pick-up roller 142 to the conveyance path 191.

The sheet P fed by the sheet feed roller pair 143 is carried forward via the conveyance drum 194 to the conveyance path 191. The sheet P carried to the conveyance path 191 is fed to the image forming section 12 by the registration roller pair 193.

The image forming section 12 is provided above the sheet feed cassette 141 and includes, a photosensitive drum 121, a charging device 122, an exposure device 123, a developing device 124, a transfer unit 120, a cleaning device 60, and a static elimination device 51.

The photosensitive drum 121 is an image carrier, is formed rotatably about an axis of rotation, and is capable of carrying a toner image on its surface. The charging device 122 has the function of electrically charging the surface of the photosensitive drum 121. The exposure device 123 irradiates the surface of the photosensitive drum 121 with laser light L based on image data sent from an external device (for example, a personal computer) to form a latent image on the surface of the photosensitive drum 121.

The developing device 124 includes a developing roller 1241 and visualizes, with toner, the latent image formed on the surface of the photosensitive drum 121.

The transfer unit 120 is made up by including a conveying belt 125 capable of conveying a sheet P, a drive roller 125A, a driven roller 125B, and a transfer roller 126.

The conveying belt 125 is mounted between the drive roller 125A and the driven roller 125B and driven in engagement against the surface of the photosensitive drum 121 by the drive roller 125A to thus travel in an endless path between both the rollers while synchronizing with the photosensitive drum 121. The transfer roller 126 is disposed at a location where the toner image is to be transferred from the surface of the photosensitive drum 121 to the sheet P and with the conveying belt 125 lying between the photosensitive drum 121 and the transfer roller 126, so that a transfer nip NP1 is formed between the transfer roller 126 and the photosensitive drum 121.

The cleaning device 60 includes a cleaning roller 61 and a cleaning blade 62. The cleaning roller 61 and the cleaning blade 62 come into contact with the surface of the photosensitive drum 121 and remove residual toner and deposits on the surface of the photosensitive drum 121 to clean the surface of the photosensitive drum 121.

The static elimination device 51 is a device for removing residual charge on the surface of the photosensitive drum 121 and, for this purpose, irradiates the surface of the photosensitive drum 121 with static eliminating light after the image formation by the image forming section 12.

The toner container 17 is removably loadable in the apparatus body 11, contains toner as a consumable material for the image forming section 12, and supplies the toner to the developing device 124.

The fixing section 13 fixes the toner image on the sheet P by the application of heat and pressure. The fixing section 13 includes a heat roller 131 serving as a fixing roller, a heat lamp 132 built in the heat roller 131 and serving as a heat source, and a pressure roller 133. The heat roller 131 and the pressure roller 133 are opposed to each other. While the sheet P is nipped and conveyed in a fixing nip NP2 formed by the heat roller 131 and the pressure roller 133, the unfixed toner image is melted by heat from the heat lamp 132 and fixed on the sheet P by pressure from the heat roller 131 and the pressure roller 133. The heat roller 131 and the pressure roller 133 are examples of the rotating bodies defined in What is claimed is.

The sheet P subjected to the fixing processing is conveyed upward along the conveyance path 191 and discharged via the output roller pair 195 to the sheet output tray 151 provided at the top of the apparatus body 11.

A description will be given of the case where double-sided printing is performed on the image forming apparatus 1. The sheet P having an image formed on one side by the image forming section 12 is nipped by the output roller pair 195, then moved back and conveyed to the reverse conveyance path 1911 by the output roller pair 195, then conveyed to the conveyance path 191 by the conveyance drum 194, and then fed again to the image forming section 12 by the registration roller pair 193. Thus, an image can also be formed on the other side of the sheet P.

Figure 2:
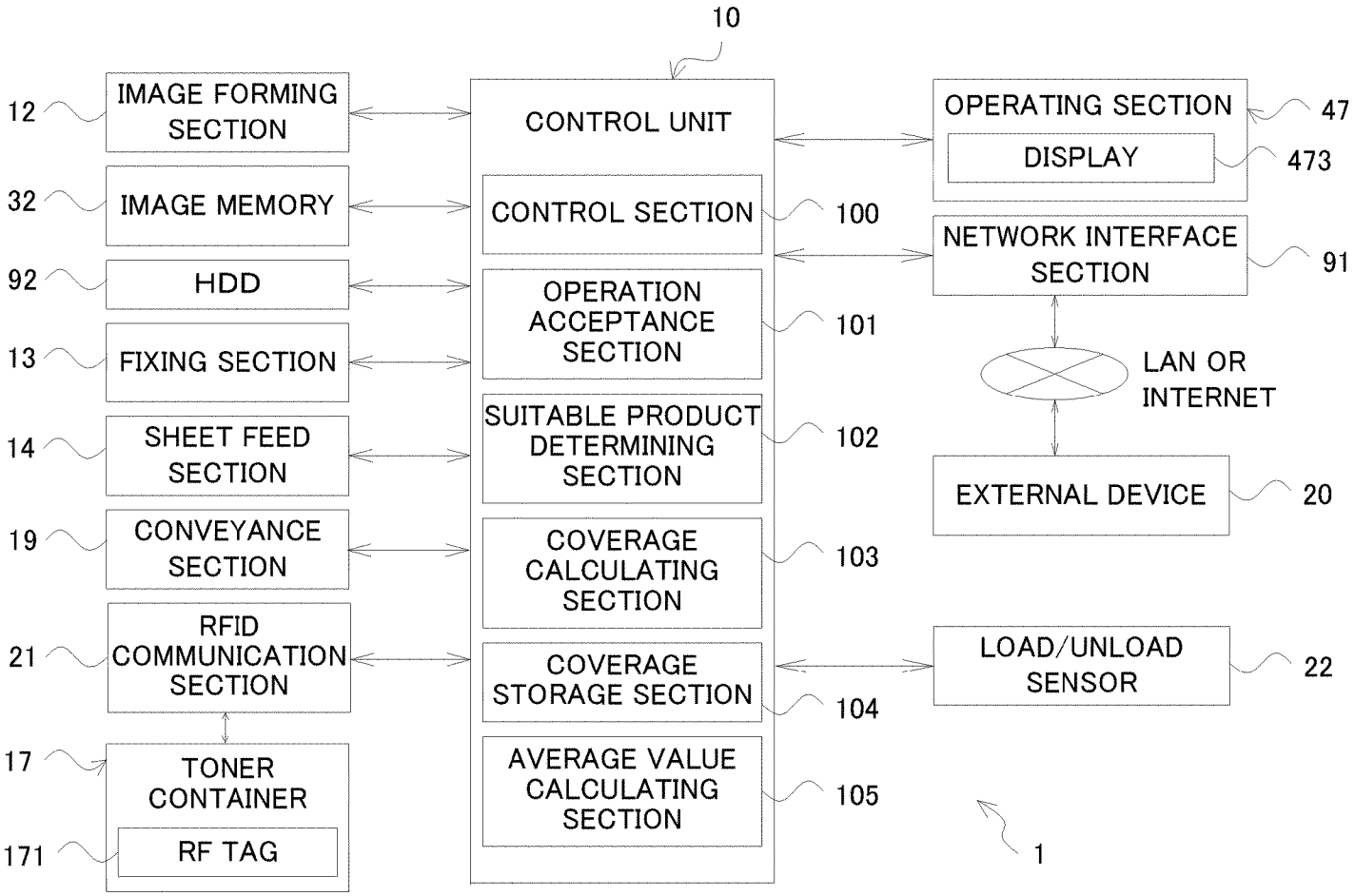
FIG. 2 is a functional block diagram schematically showing an essential internal configuration of the image forming apparatus according to the first embodiment.

FIG. 2 is a functional block diagram schematically showing an essential internal configuration of the image forming apparatus 1. The image forming apparatus 1 is made up by including a control unit 10, the image forming section 12, an image memory 32, a hard disk drive (HDD) 92, the fixing section 13, the sheet feed section 14, the conveyance section 19, an RFID communication section 21, the toner container 17, an operating section 47, a network interface section 91, and a load/unload sensor 22. The same components as those of the image forming apparatus 1 shown in FIG. 1 will be designated by the same references and further explanation thereof will be omitted here.

The image memory 32 provides a region for temporarily storing image data transmitted from an external device 20 (for example, a personal computer) and temporarily saving image data to be printed by the image forming section 12. The HDD 92 is a large storage device capable of storing image data and so on.

The RFID communication section 21 communicates with an RF tag 171 attached to the toner container 17 removably loaded in the apparatus body 11. The RF tag 171 includes a memory for storing product information or the like about the toner container 17. The RFID communication section 21 receives a signal sent from the RF tag 171 to acquire the production information or the like about the toner container 17.

The operating section 47 accepts operator's instructions for various types of operations and processing executable by the image forming apparatus 1, such as an instruction to perform an image forming operation. The operating section 47 includes a display 473 that displays operation guidance and so on for the operator. The display 473 forms a touch panel, through which the operator can touch buttons and keys displayed on the screen to operate the image forming apparatus 1.

The network interface section 91 transfers various data to and from external devices 20, including electronic devices and servers, in a local area or on the Internet. The load/unload sensor 22 detects the loading and unloading of the toner container 17 into and from the apparatus body 11.

The control unit 10 is made up by including a processor, a RAM (random access memory), a ROM (read only memory), and a dedicated hardware circuit. The processor is, for example, a CPU (central processing unit), an ASIC (application specific integrated circuit) or an MPU (micro processing unit). The control unit 10 includes a control section 100, an operation acceptance section 101, a suitable product determining section 102, a coverage calculating section 103, a coverage storage section 104, and an average value calculating section 105.

The control unit 10 functions as the control section 100, the operation acceptance section 101, the suitable product determining section 102, the coverage calculating section 103, the coverage storage section 104, and the average value calculating section 105 by the operation of the processor in accordance with a control program stored in the HDD 92. However, each of the above-mentioned control section 100 and other sections may not be implemented by the operation of the control unit 10 in accordance with the control program but may be constituted by a hardware circuit. Hereinafter, the same applies to the other embodiments unless otherwise stated.

The control section 100 governs the overall operation control of the image forming apparatus 1. The control section 100 is connected to the image forming section 12, the image memory 32, the HDD 92, the fixing section 13, the sheet feed section 14, the conveyance section 19, the RFID communication section 21, the operating section 47, the network interface section 91, and the load/unload sensor 22 and controls the operations of these components.

The operation acceptance section 101 accepts a user's input of an operation through the operating section 47. For example, when the operation acceptance section 101 accepts a user's instruction to print image data stored in the HDD 92 or the like, the control section 100 controls the operations of the image forming section 12 and so on to allow the formation of a toner image representing the image data on a sheet P.

The suitable product determining section 102 determines, based on the information acquired from the RFID communication section 21, whether or not the toner container 17 loaded in the apparatus body 11 is an inadequate product.

The coverage calculating section 103 calculates the coverage of a toner image formed on the sheet P by the image forming section 12.

The coverage storage section 104 is, for example, a memory contained in the control unit 10 and stores the coverage calculated by the coverage calculating section 103.

The average value calculating section 105 calculates the average value of the coverages of toner images on sheets P in image formations successively done a predetermined plural number of times, inclusive of the latest image formation.

Figure 3:
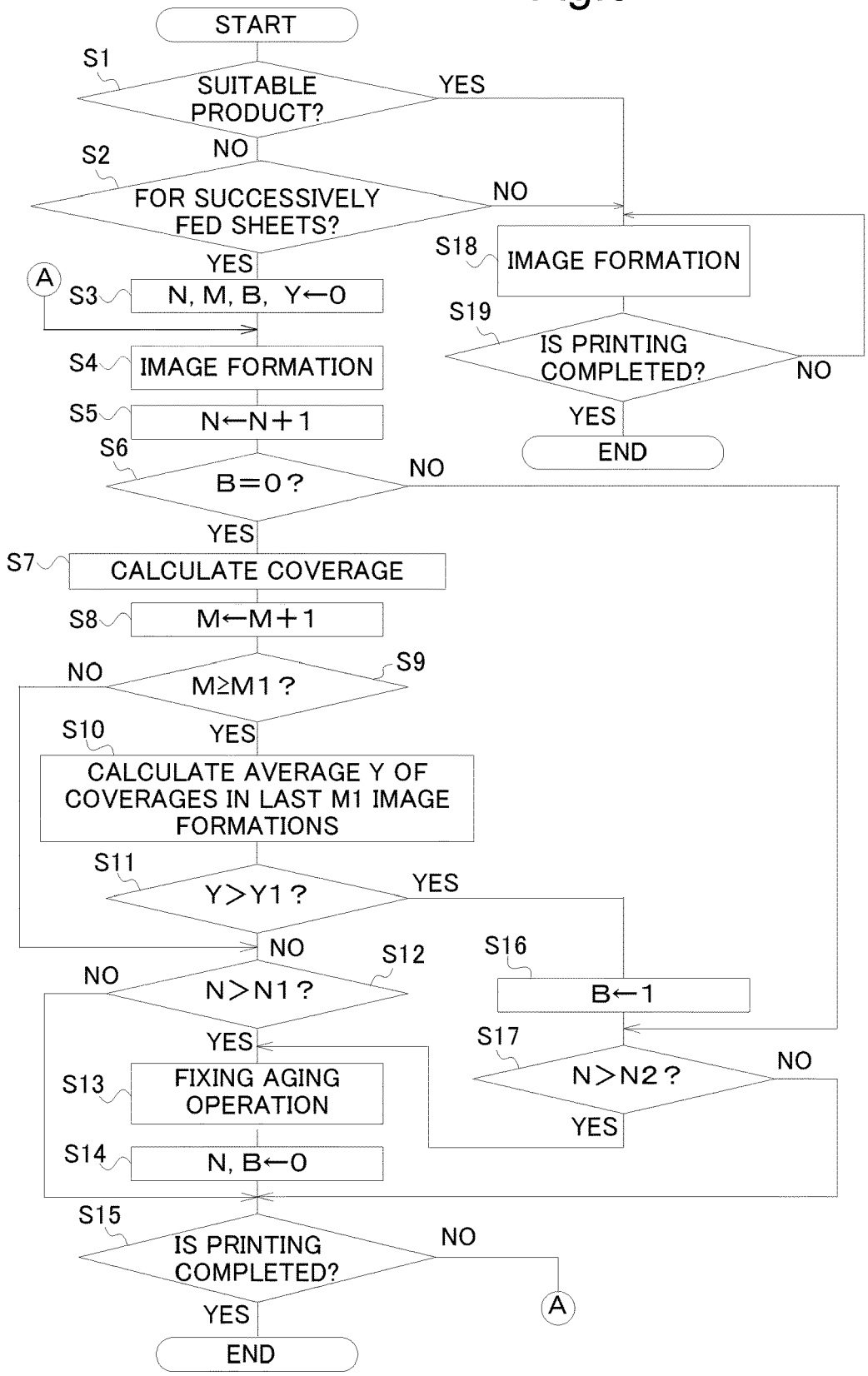
FIG. 3 is a flowchart showing an example of a processing operation performed by a control unit of the image forming apparatus according to the first embodiment.

Next, a description will be given of processing for allowing the image forming apparatus 1 according to the first embodiment to perform a fixing aging operation when an inadequate toner container is loaded therein. FIG. 3 is a flowchart showing this processing. This processing is started when the operation acceptance section 101 accepts a user's instruction to print image data stored in the HDD 92 or the like.

First, the suitable product determining section 102 determines, based on information acquired from the RFID communication section 21, whether or not the toner container 17 loaded in the apparatus body 11 is a suitable product (S1). When the suitable product determining section 102 determines that the toner container 17 loaded in the apparatus body 11 is not a suitable product (is an inadequate product) (NO in S1), the control section 100 determines whether or not printing based on the user's printing instruction accepted by the operation acceptance section 101 is for sheets to be successively fed (S2). For example, when the operation acceptance section 101 accepts a plurality of print jobs or when the operation acceptance section 101 accepts a single print job but the print job includes an instruction to print a plurality of copies, the control section 100 determines that the instructed printing is for sheets to be successively fed.

When determining that the printing is for sheets to be successively fed (YES in S2), the control section 100 resets counters N, M for counting the number of sheets subjected to image formation (number of print copies) to 0, sets a high coverage flag B indicating whether the average value Y of coverages of toner images formed on sheets P (specifically, the average value Y of coverages in image formations successively done a predetermined plural number of times M1, inclusive of the latest image formation) is high or low to 0 (0: the average value is not high, 1: the average value is high), and resets the average value Y to 0 (S3). The counter N is a counter for counting the number of print copies. The counter M is a counter for counting the number of print copies for use in determining whether or not a timing to calculate the coverage has come.

Subsequently, the control section 100 controls the operations of the image forming section 12 and so on based on the user's printing instruction accepted by the operation acceptance section 101 to allow the formation of a toner image on a sheet P (S4), adds 1 to the counter N (S5), and then determines whether or not the high coverage flag B is 0 (S6).

When the control section 100 determines that the high coverage flag B is 0 (YES in S6), the coverage calculating section 103 calculates the coverage of the toner image formed on the sheet P by the image forming section 12 and allows the coverage storage section 104 to store the calculated coverage in the order of calculations (S7). Thereafter, the control section 100 adds 1 to the counter M (S8) and determines whether or not the counter M has reached the predetermined plural number of times M1 (for example, 10 times) (S9). The coverage calculating section 103 determines the coverage by calculating the area of the toner image per unit area, for example, the percentage of the total area of printed dots formed in the total printable area of the sheet P.

When the control section 100 determines that the counter M has reached the plural number of times M1 (YES in S9), the average value calculating section 105 acquires from the coverage storage section 104 the coverages in image formations successively done the predetermined plural number of times M1, inclusive of the latest image formation, and calculates the average value Y of the acquired coverages in the plural number M1 of image formations (S10). In other words, the average value calculating section 105 calculates the average value Y of coverages in the last ten successive image formations.

Subsequently, the control section 100 determines whether or not the average value Y calculated by the average value calculating section 105 is over a predetermined threshold value Y1 (for example, 30%) (S11). When determining that the average value Y is not over the threshold value Y1 (i.e., the coverage is not high) (NO in S11), the control section 100 determines whether or not the counter N is over a predetermined number of sheets N1 (for example, 20 sheets) (S12).

When in S9 the control section 100 determines that the counter M has not reached the plural number of times M1 (NO in S9), this mean that information on the coverages in ten image formations has not been obtained. Therefore, the process skips S10 and S11 and goes to S12.

When determining that the counter N is over the predetermined number of sheets N1 (YES in S12), the control section 100 controls the operations of the image forming section 12 and the fixing section 13 to allow a fixing aging operation for stopping the image forming operation and rotating the rotating bodies (the heat roller 131 and the pressure roller 133) of the fixing section 13 without feeding a sheet therebetween to be performed (S13). Thereafter, the control section 100 resets the counter N to 0 and sets the high coverage flag B to 0 (S14).

Subsequently, the control section 100 determines whether or not the print processing based on the user's printing instruction accepted by the operation acceptance section 101 is completed (S15). When determining that the print processing is completed (YES in S15), the control section 100 ends the operation for this processing. On the other hand, when the control section 100 determines that the print processing is not completed (NO in S15), the process goes back to S4 to continue image formation processing.

When in S12 the control section 100 determines that the counter N is not over the predetermined number of sheets N1 (NO in S12), this means that the fixing aging operation need not be performed. Therefore, the process skips S13 and S14 and goes to S15.

When in S11 the control section 100 determines that the average value Y calculated by the average value calculating section 105 is over the predetermined threshold value Y1 (i.e., the coverage is high) (YES in S11), the control section 100 sets the high coverage flag B to 1 (S16). Then, the control section 100 determines whether or not the counter N is over a predetermined number of sheets N2 (for example, 10 sheets) (S17). The predetermined number of sheets N2 is a number of sheets reduced by a predetermined number from the above-described predetermined number of sheets N1.

When determining that the counter N is over the predetermined number of sheets N2 (YES in S17), the control section 100 stops the image forming operation and allows the fixing aging operation to be performed (S13). Thereafter, the control section 100 resets the counter N to 0 and sets the high coverage flag B to 0 (S14).

On the other hand, when in S17 the control section 100 determines that the counter N is not over the predetermined number of sheets N2 (NO in S17), this means that the fixing aging operation need not be performed. Therefore, the process goes to S15.

When in S6 the control section 100 determines that the high coverage flag B is not 0 (i.e., the high coverage flag B is 1, that is, the coverage is high) (NO in S6), this means that there is no need for the processing (S7 to S11) for determining whether or not to be in a high coverage state. Therefore, the process goes to S17.

When in S1 the suitable product determining section 102 determines that the toner container 17 loaded in the apparatus body 11 is a suitable product (YES in S1) or when in S2 the control section 100 determines that the printing is not for sheets to be successively fed (NO in S2), this means that there is no need for the fixing aging operation conditional on the occurrence of successive feeding of sheets. Therefore, the control section 100 controls the operations of the image forming section 12 and so on based on the user's printing instruction accepted by the operation acceptance section 101 to allow the formation of a toner image on a sheet P (S18). When determining that the print processing based on the user's printing instruction accepted by the operation acceptance section 101 is completed (YES in S19), the control section 100 ends the operation for this processing.

According to the first embodiment, when an inadequate toner container 17 is loaded in the apparatus body 11, on condition that successive feeding of sheets for image formation is performed, the fixing aging operation is performed after every predetermined number of sheets N1 (for example, 20 sheets) have been subjected to an image forming operation. Therefore, during the successive feeding of sheets while an inadequate toner is used, the fixing section 13 is kept at a high temperature. Thus, even if the inadequate toner is not a low-melting-point toner, unlike a suitable toner, the toner can be prevented from fixing to the surfaces of the rotating bodies of the fixing section 13. This provides stable image formation and prevents failure in the image forming apparatus 1. Furthermore, in the first embodiment, as high-coverage printing is more successively performed, the interval between fixing aging operations becomes shorter. Therefore, it can be more certainly prevented that the toner fixes to the surfaces of the rotating bodies of the fixing section 13.

The control of the fixing temperature in an image forming apparatus is configured according to the thermal properties and charging properties of a suitable toner. Therefore, with the use of an inadequate toner different in these properties from the suitable toner, the difference in thermal properties or charging properties from the suitable toner may cause an offset (a phenomenon where a portion of a toner image formed on a sheet adheres to the fixing roller and is thus stripped off by the fixing roller) in the fixing section. For example, if the amount of heat during melting of the toner is insufficient, a so-called cold offset occurs. On the other hand, if the amount of heat during melting of the toner is excessive, a so-called hot offset occurs.

If such an offset continues, the toner (offset toner) adhering to the fixing roller is firmly fixed thereto to decrease the toner releasability (non-tackiness) of the fixing roller, so that toner fixation is further promoted. Furthermore, because the offset toner also comes into contact with the pressure roller opposed to the fixing roller, the offset toner is transferred from the fixing roller to the pressure roller and then firmly fixed to the pressure roller.

If the toner fixation to the fixing roller and the pressure roller progresses, the degree of offset increases, so that the toner fixed to the rollers may fall off and adhere to a sheet carried between the rollers, resulting in the occurrence of an image defect due to contamination with toner. Furthermore, if the toner is fixed to sheet separating claws or a thermistor provided around the fixing roller, the surface of the fixing roller is excessively scraped by the sheet separating claws or the thermistor, so that the durability life of the fixing roller may be significantly shortened.

In addition, once the toner is fixed to the fixing roller, in most cases even if the toner is returned to a suitable product, the image forming apparatus cannot recover a normal condition, resulting in failure.

In image forming apparatuses, the melting point of the toner is becoming lower in order to reduce the fixing temperature to a low temperature from the viewpoints of faster processing of a larger number of sheets and energy saving. Furthermore, during successive feeding of sheets (successive fixing operations for a plurality of sheets), the heat of the fixing roller is taken away by the sheets. In order to cope with this and maintain the fixing temperature at a high temperature, it is necessary to increase the amount of heat required per unit time. However, from the viewpoint of energy saving, the power consumption needs to be saved. Therefore, it is difficult to secure a large amount of heat required per unit time. In other words, it is difficult to maintain the fixing temperature at a high temperature. Hence, also from this viewpoint, the fixing temperature tends to be lowered and the lowering of the toner melting point is desired.

Because a suitable toner is produced on the assumption that the fixing temperature may be lowered, no offset occurs in an image forming apparatus using the suitable toner so long as successive feeding of sheets for fixing is performed within the performance of the image forming apparatus (at a speed where successive printing is possible). Unlike this, an inadequate toner is not necessarily produced on the assumption that the fixing temperature may be lowered. Therefore, with the use of an inadequate toner not matching the toner properties assumed for the image forming apparatus, a cold offset may occur in the image forming apparatus even if successive feeding of sheets for fixing is performed within the performance. Particularly when a high-coverage image is successively printed on sheets, a cold offset becomes likely to occur, so that toner fixing to the fixing roller is likely to progress.

As described previously in the above BACKGROUND, there is a general image forming apparatus in which a display panel displays a warning message informing the user that an inadequate toner container is loaded. However, if the user ignores the warning message and continues to use the inadequate toner container, this may cause not only an image defect but also failure in the image forming apparatus itself.

In contrast, in the above first embodiment, toner can be prevented from fixing to the surfaces of the rotating bodies (such as the fixing roller) of the fixing section due to successive feeding of sheets, which provides stable image formation and prevents failure in the image forming apparatus.

When a suitable toner container 17 is loaded in the apparatus body 11, the fixing aging operation conditional on the occurrence of successive feeding of sheets is not performed. During the successive feeding of sheets while a suitable toner is used, no offset occurs so long as the successive feeding of sheets is performed within the performance of the image forming apparatus 1. Therefore, in this case, the fixing aging operation is not performed in order to avoid that an unnecessary fixing aging operation is performed to stop the image forming operation and thus reduce the productivity.

According to the first embodiment, when an inadequate toner container is loaded in the apparatus body, on condition that successive feeding of sheets for image formation is performed, the fixing aging operation is performed after every predetermined number of sheets (for example, 20 sheets) have been subjected to an image forming operation. The fixing aging operation is an operation for driving the rotating bodies of the fixing section into rotation, for example, during a period of time when the fixing operation of the fixing section is not performed (a period of time when the image forming operation is not performed). Thus, the temperatures (particularly, the surface temperatures) of the rotating bodies of the fixing section are raised.

Therefore, during the successive feeding of sheets while an inadequate toner is used, the rotating bodies of the fixing section can be kept at a high temperature. Thus, even if the inadequate toner is not a low-melting-point toner, unlike a suitable toner, the toner can be prevented from fixing to the surfaces of the rotating bodies of the fixing section. This provides stable image formation and prevents failure in the image forming apparatus. When a suitable toner container is loaded in the apparatus body, in order to avoid reduction in productivity, the fixing aging operation conditional on the occurrence of successive feeding of sheets is not performed.

Figure 4:
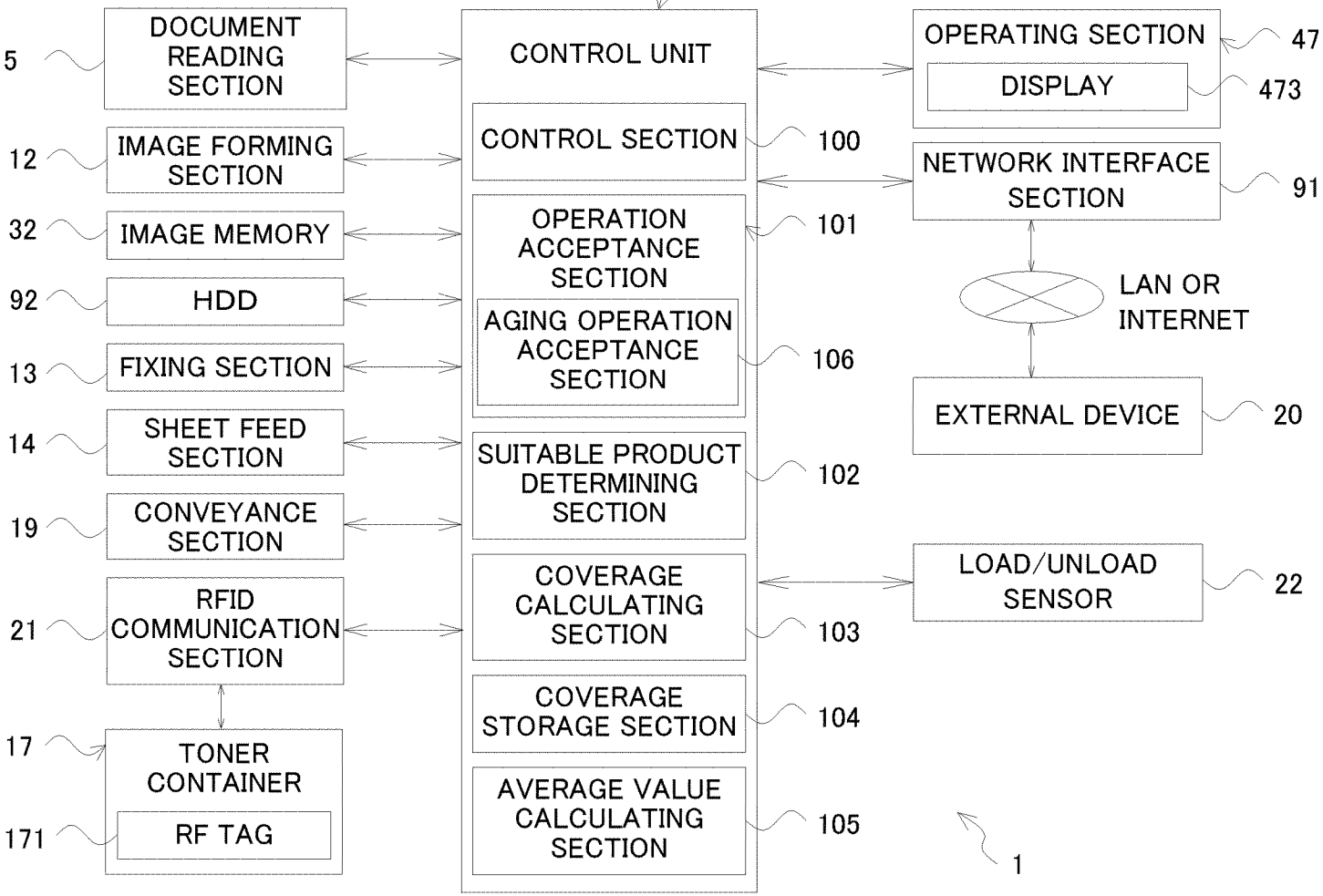
FIG. 4 is a functional block diagram schematically showing an essential internal configuration of an image forming apparatus according to a second embodiment.

FIG. 4 is a functional block diagram schematically showing an essential internal configuration of an image forming apparatus according to a second embodiment. Further explanation of the same structure as in the first embodiment will not be omitted. In the image forming apparatus according to the second embodiment, the operation acceptance section 101 includes an aging operation acceptance section 106 that accepts from the user an instruction to execute the fixing aging operation conditional on the occurrence of successive feeding of sheets or an instruction to cancel the execution of the fixing aging operation. Furthermore, the image forming apparatus according to the second embodiment is different from the image forming apparatus according to the first embodiment in that while the aging operation acceptance section 106 has not accepted the user's instruction to execute the fixing aging operation, the control section 100 keeps the fixing aging operation from being performed.

When accepting the instruction to execute the fixing aging operation through the operating section 47 from the user, the aging operation acceptance section 106 sets an execution flag F (having 0 as an initial value) indicating the execution/non-execution of the fixing aging operation to 1. On the other hand, when accepting the instruction to cancel the execution of the fixing aging operation from the user, the aging operation acceptance section 106 sets the execution flag F to 0.

Figure 5:
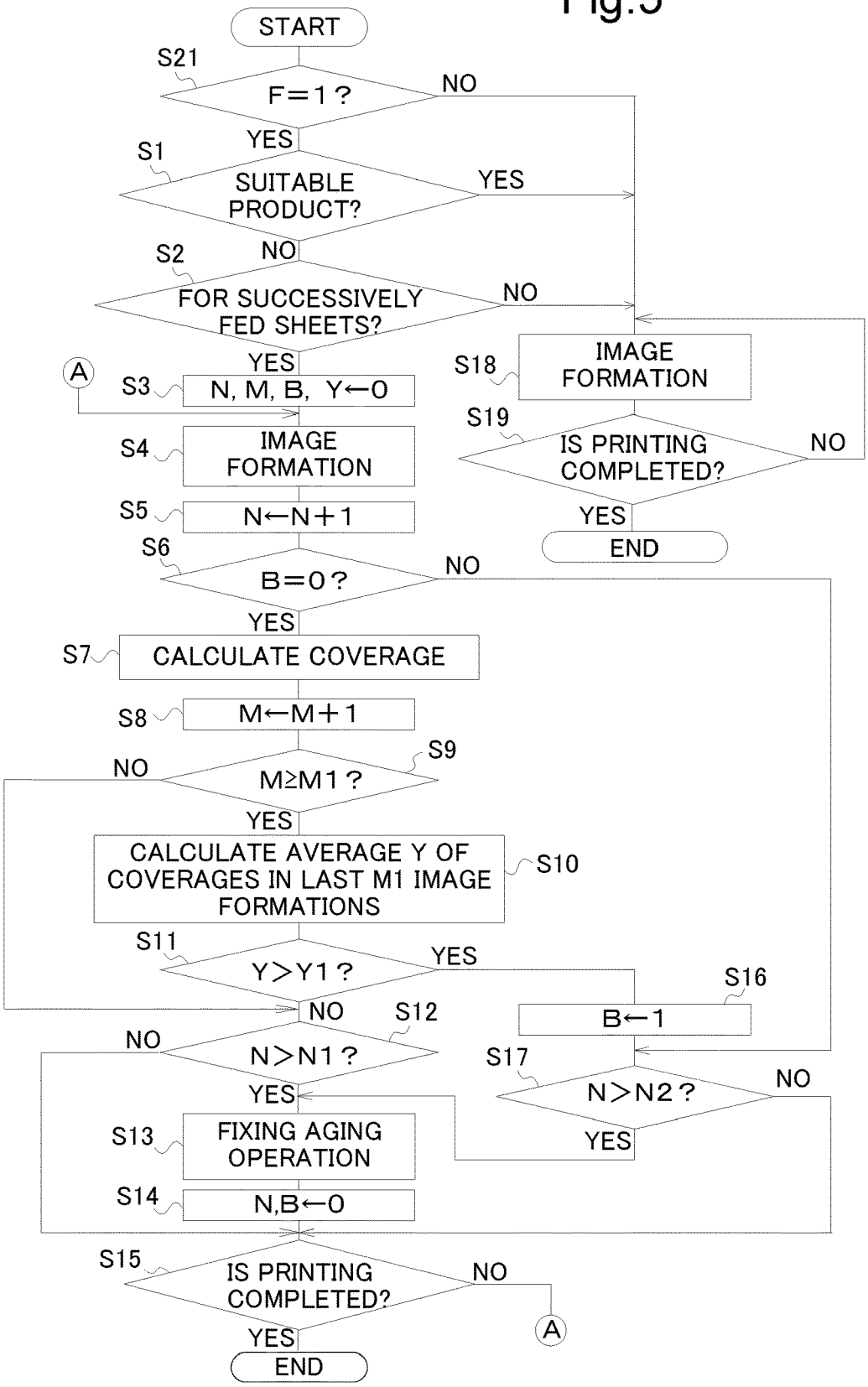
FIG. 5 is a flowchart showing an example of a processing operation performed by a control unit of the image forming apparatus according to the second embodiment.

Next, a description will be given of processing for allowing the image forming apparatus 1 according to the second embodiment to perform the fixing aging operation when an inadequate toner container is loaded therein. FIG. 5 is a flowchart showing this processing. Because the processing in the second embodiment is the same as in the first embodiment except for S21 inserted between START and S1 in FIG. 3, further explanation of the same processing steps as those shown in FIG. 3 will be accordingly omitted.

First, the control section 100 determines whether or not the execution flag F is 1 (S21). When determining that the execution flag F is 1 (YES in S21), the control section 100 allows the process to go to S1 and enables the fixing aging operation. On the other hand, when determining that the execution flag F is not 1 (the execution flag F is 0) (NO in S1), the control section 100 allows the process to go to S18 and keeps the fixing aging operation from being performed.

According to the second embodiment, the user can select to execute or not to execute the fixing aging operation conditional on the occurrence of successive feeding of sheets. Therefore, it can be prevented that the fixing aging operation is performed without user's request.

In a third embodiment, when the suitable product determining section 102 determines that the toner container loaded in the apparatus body 11 is not a suitable product, the control section 100 may control, at a predetermined presentation timing, the operations of the conveyance section 19, the image forming section 12, and the fixing section 13 to allow the formation of a predetermined image pattern on a sheet P and the discharge of the sheet P serving as a check sheet to the sheet output tray 151, thus presenting the check sheet to the user.

The predetermined presentation timing is, for example, after image formation on every predetermined number of (for example, 500) sheets since the replacement of the toner container 17 loaded in the apparatus body 11 from a suitable product to an inadequate product, or when every predetermined time period (for example, one week) has passed since the replacement. The determination of whether or not the toner container 17 has been replaced can be made by the control section 100 based on information acquired from the load/unload sensor 22.

The predetermined image pattern is an image that enables visual check of the surface conditions of the rotating bodies of the fixing section 13 and, for example, a low-density solid gray image having a predetermined density (50%) and enabling the detection of toner adhering to the surfaces of the rotating bodies of the fixing section 13.

According to the third embodiment, when an inadequate toner container 17 is loaded in the apparatus body 11, a check sheet representing the surface conditions of the rotating bodies of the fixing section 13 is periodically presented to the user. Therefore, the user is periodically prompted to check the surface conditions of the rotating bodies. Thus, it can be prevented that, despite the adhesion of toner on the surfaces of the rotating bodies, the user does not instruct to execute the fixing aging operation and the fixing aging operation is not performed.

Figure 6:
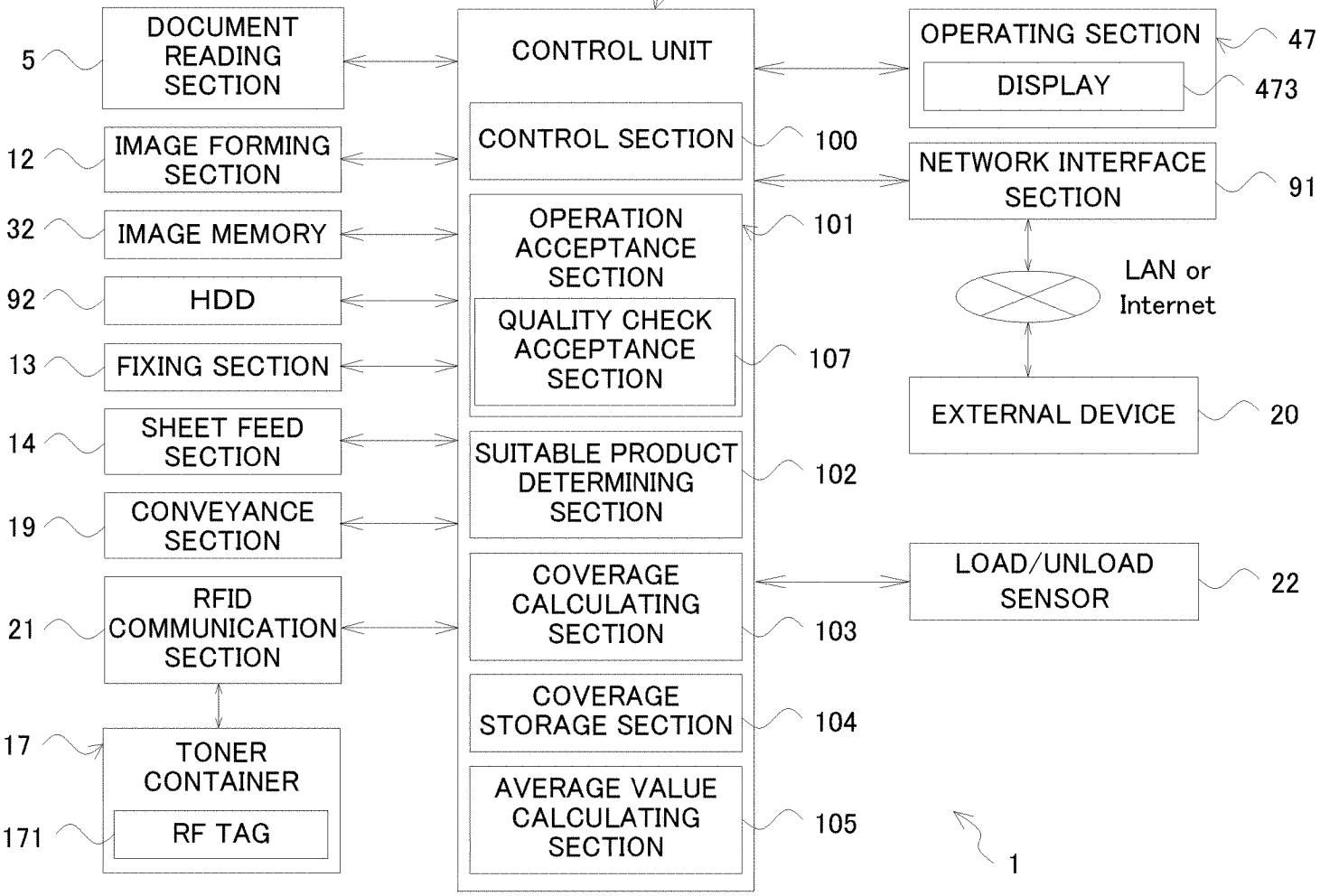
FIG. 6 is a functional block diagram schematically showing an essential internal configuration of an image forming apparatus according to a fourth embodiment.

Whether the quality of the surface conditions of the rotating bodies is good or poor may be checked not by the user but by the image forming apparatus 1. Specifically, in a fourth embodiment, as shown in FIG. 6, the image forming apparatus 1 further includes a document reading section 5 and the operation acceptance section 101 further includes a quality check acceptance section 107. Further explanation of the same structure as shown in FIG. 2 will not be omitted.

The document reading section 5 irradiates an original document placed on an original glass plate with light using a lighting part and receives the reflected light, thus reading an image from the original document. The image data acquired by the reading of the document reading section 5 is stored in the image memory 32 or the like.

Like the third embodiment, when an inadequate toner container 17 is loaded in the apparatus body 11, the control section 100 periodically presents to the user a check sheet representing the surface conditions of the rotating bodies of the fixing section 13.

The quality check acceptance section 107 accepts, through the operating section 47 from the user, an instruction to check the quality of the surface conditions of the rotating bodies of the fixing section 13. For example, when, with the check sheet placed on the original glass plate by the user, the quality check acceptance section 107 accepts the instruction to check the quality of the surface conditions, the control section 100 allows the document reading section 5 to read the check sheet placed on the original glass plate and determines whether the surface conditions of the rotating bodies of the fixing section 13 are good or poor based on the image data acquired by the reading of the document reading section 5.

For example, the control section 100 checks original image data as a reference for the check sheet against the image data acquired by the reading of the document reading section 5, for example, by pattern matching or other processing. When the difference obtained by the check is within a predetermined range, the control section 100 determines that the surface conditions are good. When the difference is out of the predetermined range, the control section 100 determines that the surface conditions are poor.

When determining that the surface conditions are good, the control section 100 sets the execution flag F (having an initial value of 0) indicating the execution/non-execution of the fixing aging operation to 0. When determining that the surface conditions are poor, the control section 100 sets the execution flag F to 1.

In the fourth embodiment, since whether the quality of the surface conditions of the rotating bodies of the fixing section 13 is checked not by the user but by the image forming apparatus 1 itself, the execution or non-execution of the fixing aging operation can be more appropriately selected.

Even if the toner container 17 is replaced from an inadequate product to a suitable product, the toner in the developing device 124 immediately after the replacement is still the inadequate product and the toner in the developing device 124 is gradually replaced from an inadequate toner to a suitable toner. Although the period until full toner replacement depends on the size of the developing device 124, a general developing device 124 treating magnetic single-component toner requires printing on about 20000 to about 30000 sheets until the full toner replacement.

Therefore, in still another embodiment, when the control section 100 determines, based on the determination result of the suitable product determining section 102, that the toner container 17 loaded in the apparatus body 11 has been replaced from an inadequate product to a suitable product, the control section 100 may enable the fixing aging operation conditional on the occurrence of successive feeding of sheets until a predetermined time period has passed.

In this case, when the toner container 17 loaded in the apparatus body 11 has been replaced from an inadequate product to a suitable product, the control section 100 may further allow the display 473 to display a message "Inadequate toner has been used in the past. The developing device contains the inadequate toner. To keep image quality and prevent failure, a fixing aging operation will be performed after every successive printing of 20 or more sheets until the end of printing of 20000 sheets".

Alternatively, until the predetermined time period has passed, in place of the execution of the fixing aging operation, the control section 100 may allow the display 473 to display a message informing the user of a way of coping with the occurrence of an image defect (for example, a message prompting to execute an operation for cleaning the fixing roller) immediately after the replacement with a suitable toner container 17 or periodically.

An example of the predetermined time period is a period of printing on about 20000 to 30000 sheets which it will take to fully replace toner in the developing device 124. Alternatively, if the toner contained in a single toner container 17 can provide printing comparable to printing on the above-mentioned number of sheets (for example, can provide printing on 25000 sheets), the period of use of the single toner container 17 may be set as the predetermined time period.

The present disclosure is not limited to the above embodiments and can be modified in various ways. Although the description of the above embodiments is given taking a printer as an example of the image forming apparatus according to the present disclosure, the example is merely illustrative and the image forming apparatus may be any other image forming apparatus, such as a multifunction peripheral having a plurality of functions, for example, a copy function, a print function, a scan function, and a facsimile function, a copier or a facsimile machine.

The structures, configurations, and processing shown in the above embodiments with reference to FIGS. 1 to 6 are merely illustrative of the present disclosure and the present disclosure is not intended to be limited to the above structures, configurations, and processing.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image forming section that includes an image carrier and forms a toner image on a surface of the image carrier;

a fixing section that nips, at a fixing nip between two rotating bodies, a sheet having the toner image formed in the image forming section and applies heat and pressure to the nipped sheet to fix the toner image on the sheet;

a toner container that is removably loadable in an apparatus body of the image forming apparatus and contains toner for use in forming the toner image in the image forming section;

a suitable product determining section that determines whether or not the toner container loaded in the apparatus body is a suitable product; and a control section that controls operations of the image forming section and the fixing section, wherein the image forming section includes a developing device that supplies to the image carrier the toner supplied from the toner container and forms the toner image on the image carrier, and wherein when the suitable product determining section determines that the toner container loaded in the apparatus body is not a suitable product, on condition that successive feeding of sheets for image formation is performed, the control section allows, after every predetermined number of sheets have been subjected to an image forming operation, a fixing aging operation for stopping the image forming operation and rotating the rotating bodies of the fixing section to be performed, when the suitable product determining section determines that the toner container loaded in the apparatus body is a suitable product, the control section keeps the fixing aging operation conditional on occurrence of the successive feeding of the sheets from being performed, and when a determination result of the suitable product determining section changes from a determination that the toner container is an inadequate product to a determination that the toner container is a suitable product, the control section further controls operations of the conveyance section, the image forming section, and the fixing section to enable the fixing aging operation conditional on the occurrence of the successive feeding of sheets until a predetermined time period has passed.

2. An image forming apparatus comprising:

an image forming section that includes an image carrier and forms a toner image on a surface of the image carrier;

a fixing section that nips, at a fixing nip between two rotating bodies, a sheet having the toner image formed in the image forming section and applies heat and pressure to the nipped sheet to fix the toner image on the sheet;

a toner container that is removably loadable in an apparatus body of the image forming apparatus and contains toner for use in forming the toner image in the image forming section;

a suitable product determining section that determines whether or not the toner container loaded in the apparatus body is a suitable product; and a control section that controls operations of the image forming section and the fixing section, wherein the image forming section includes a developing device that supplies to the image carrier the toner supplied from the toner container and forms the toner image on the image carrier, and wherein when the suitable product determining section determines that the toner container loaded in the apparatus body is not a suitable product, on condition that successive feeding of sheets for image formation is performed, the control section allows, after every predetermined number of sheets have been subjected to an image forming operation, a fixing aging operation for stopping the image forming operation and rotating the rotating bodies of the fixing section to be performed, and when the suitable product determining section determines that the toner container loaded in the apparatus body is a suitable product, the control section keeps the fixing aging operation conditional on occurrence of the successive feeding of the sheets from being performed, the image forming apparatus further comprising:

a document reading section that reads an image of an original document placed on an original glass plate;

a conveyance section that conveys the sheet;

a sheet output tray to which the sheet having the toner image fixed thereon by the fixing section is discharged; and a quality check acceptance section that accepts from a user an instruction to check a quality of surface conditions of the rotating bodies of the fixing section, wherein when the suitable product determining section determines that the toner container loaded in the apparatus body is not a suitable product, the control section controls, at a predetermined presentation timing, operations of the conveyance section, the image forming section, and the fixing section to allow formation of a predetermined image pattern on the sheet and discharge of the sheet serving as a check sheet to the sheet output tray, thus presenting the check sheet to the user, the predetermined image pattern is an image that enables visual check of surface conditions of the rotating bodies of the fixing section, when the quality check acceptance section accepts the instruction to check the quality of the surface conditions from the user, the control section allows the document reading section to read the check sheet placed on the original glass plate and determines whether the surface conditions of the rotating bodies of the fixing section are good or poor based on image data acquired by reading of the check sheet by the document reading section, when determining that the surface conditions are good, the control section keeps the fixing aging operation conditional on the occurrence of the successive feeding of sheets from being performed, when determining that the surface conditions are poor, the control section allows the fixing aging operation conditional on the occurrence of the successive feeding of sheets to be performed, the control section checks, by pattern matching, original image data as reference for the check sheet against the image data of the check sheet acquired by the reading of the document reading section;

when a difference obtained by the check is within a predetermined range, the control section determines that the surface conditions of the rotating bodies of the fixing section are good; and when the difference is out of the predetermined range, the control section determines that the surface conditions are poor.

* * * * *